US006969164B2

(12) United States Patent
Kerr et al.

(10) Patent No.: US 6,969,164 B2
(45) Date of Patent: Nov. 29, 2005

(54) PRINTING CARTRIDGE HAVING A FILTER TOWER ASSEMBLY AND PROCESS FOR FORMING THE SAME

(75) Inventors: James A. Kerr, Lexington, KY (US); Kin M. Kwan, Lexington, KY (US); Ganesh V. Phatak, Lexington, KY (US); Jeanne M. Saldanha Singh, Lexington, KY (US); Paul T. Spivey, Lexington, KY (US); Jon B. Whitney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 214 days.

(21) Appl. No.: 10/703,283

(22) Filed: Nov. 7, 2003

(65) Prior Publication Data

US 2005/0099472 A1 May 12, 2005

(51) Int. Cl.[7] ..... B41J 2/175; B41J 2/17
(52) U.S. Cl. ..... 347/86; 347/87; 347/93
(58) Field of Search ..... 347/50, 86–87, 347/92–93; 210/449, 451, 459, 462, 471, 210/477, 482

(56) References Cited

U.S. PATENT DOCUMENTS

| | | | | |
|---|---|---|---|---|
| 4,771,295 | A | 9/1988 | Baker et al. | |
| 5,537,136 | A * | 7/1996 | Brandon et al. | 347/87 |
| 5,680,164 | A | 10/1997 | Miller et al. | |
| 6,199,979 | B1 | 3/2001 | Hobson et al. | |
| 6,293,664 | B1 * | 9/2001 | DeFosse et al. | 347/87 |
| 6,328,424 | B1 * | 12/2001 | Denton et al. | 347/50 |
| 6,422,692 | B2 | 7/2002 | Yamazaki et al. | |
| 6,513,920 | B1 * | 2/2003 | Deshmukh et al. | 347/92 |
| 2002/0126188 | A1 | 9/2002 | Otis, Jr. et al. | |
| 2002/0191058 | A1 | 12/2002 | Anderson et al. | |

* cited by examiner

*Primary Examiner*—K. Feggins
(74) *Attorney, Agent, or Firm*—Ronald K. Aust

(57) ABSTRACT

A printing cartridge including a body, the body having a base and a tower defining a passageway. The tower is made from a first polymer material, and has a proximal end and a distal end. The proximal end is attached to the base. The distal end includes a surface. A frame, made of a second polymer material different from the first polymer material, is attached to the surface of the tower. A filter is attached to the frame and positioned to extend over the passageway.

24 Claims, 6 Drawing Sheets

PRINTING CARTRIDGE HAVING A FILTER TOWER ASSEMBLY AND PROCESS FOR FORMING THE SAME

BACKGROUND OF THE INVENTION

1. Field of the Invention

The present invention relates to a printing cartridge, and, more particularly, to a printing cartridge having a filter tower assembly and a process for forming the same.

2. Description of the Related Art

A printing cartridge includes a body forming an ink reservoir. One form of a printing cartridge, know as an ink jet printhead cartridge, combines ink storage and drop ejection functions into a unitary package. The ink jet printhead cartridge body has a base for attachment of a printhead. The ink reservoir may include one or more chambers containing an ink-saturated porous material, such as for example, a polyurethane foam. The printhead includes a nozzle plate including a plurality of ink jetting nozzles, fluidic passages and chambers for receiving and transporting ink to the ink jetting nozzles, and selectable electrical components which when actuated cause ink to be ejected from one or more of the ink jetting nozzles.

An interconnection between the ink reservoir and the printhead is provided, at least in part, by a tower, sometimes also referred to as a standpipe, that extends upwardly from the base. In order to prevent the introduction of particulate matter and/or air bubbles into the flow path of the interconnection from the ink reservoir to the ink jetting nozzles of the printhead, a filter is typically attached to the tower, and hence, the tower/filter combination is sometimes also referred to as a filter tower. The filter may be in the form of a fine mesh stainless steel filter affixed to the entrance of the tower. The filter also acts as a capillary drain, allowing ink passage upon demand but preventing air passage into the tower. One known filter attach method uses an adhesive to attach the filter to the tower.

It is known to form the body of an ink jet printhead cartridge from an amorphous polymer. Polymers which are amorphous typically allow for easier joining to other substances, such as a metal. The reason for this is that the amorphous polymers tend to soften when heated to their heat deflection temperatures rather than melting. In contrast, a crystalline or semi-crystalline polymer will tend to melt at a given temperature. One significant difference between the behaviors amorphous polymers and crystalline polymers, for example, is the viscosity of the heated polymer. A softened amorphous polymer still has a very high viscosity, and therefore, the material itself retains a significant amount of strength which aids in joining materials. In contrast, a highly crystalline polymer above its melt temperature drops dramatically in viscosity. Due to this drop in viscosity, the crystalline polymer material does not retain as much strength as a softened amorphous polymer, and therefore, joining a crystalline polymer with another material, such as for example, metal, becomes more complicated.

For example, for an ink jet printhead cartridge made from an amorphous polymer, the stainless steel filter can simply be heated by direct contact with another heated material, such as a copper heating block, and then pressed into the amorphous polymer. The amorphous polymer will soften and under pressure can be extruded through the mesh in the stainless steel filter. While the system is still at the softening temperature of the amorphous polymer the heated block can be retracted, leaving the filter attached to the amorphous polymer. The amorphous polymer retains enough strength to hold the filter mesh in place even while above its softening temperature.

The heat staking process noted above for use with an amorphous printing cartridge body will not provide acceptable results for printing cartridges having a body formed from a crystalline polymer or a semi-crystalline polymer. For example, when the filter is heated and pressed into a crystalline polymer, if the temperature is below the melt temperature, then the crystalline polymer will not melt, nor will it soften enough to extrude through the filter mesh. Upon reaching the polymer melt temperature, the crystalline polymer will indeed melt and flow through the filter mesh; however, it does not have enough strength to hold the filter in place when the heated block is removed. As the melted crystalline polymer flows through the filter mesh and contacts the heated block it will tend to pull up with the heated block when the heated block is retracted, and pull the filter with it. This causes a compromise in the welded interface of the filter to the crystalline polymer. Accordingly, the existing heat staking process of filter attachment is not ideal for printing cartridge bodies formed from crystalline or semi-crystalline polymers.

What is needed in the art is a printing cartridge including a filter tower assembly having a tower formed from a crystalline or semi-crystalline polymer, wherein the filter tower assembly can be formed by a relatively simple, cost-effective and reliable process for attaching the filter, such as a metal mesh filter, to the crystalline or semi-crystalline polymer tower.

SUMMARY OF THE INVENTION

The present invention provides a printing cartridge including a filter tower assembly having a tower formed from a crystalline or semi-crystalline polymer, wherein the filter tower assembly may be formed by a relatively simple, cost-effective and reliable process for attaching the filter, such as a metal mesh filter, to the crystalline or semi-crystalline polymer tower.

The invention comprises, in one form thereof, a printing cartridge including a body. The body includes a base and a tower defining a passageway. The tower is made from a first polymer material, and has a proximal end and a distal end. The proximal end is attached to the base. The distal end includes a surface. A frame, made of a second polymer material different from the first polymer material, is attached to the surface of the tower. A filter is attached to the frame and positioned to extend over the passageway.

One advantage of the present invention is that a filter may be attached to a printing cartridge tower made from a crystalline or semi-crystalline polymer without increasing the complexity of the attachment or dramatically increasing the costs of the raw components used in forming a filter tower assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1A:
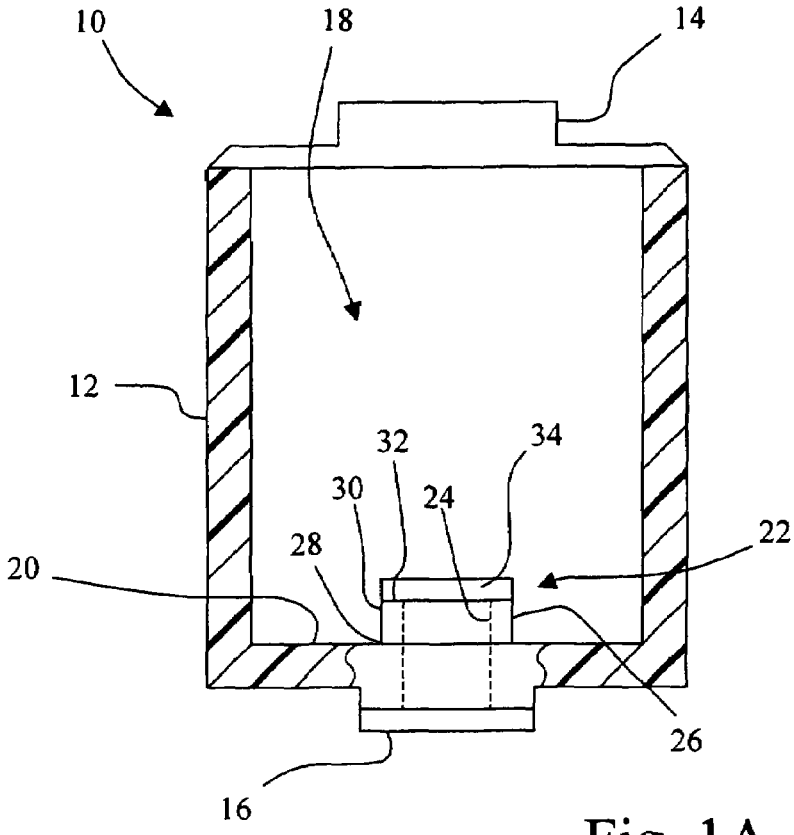
FIG. 1A is a side sectional view of a printing cartridge embodying the present invention.
Figure 1B:
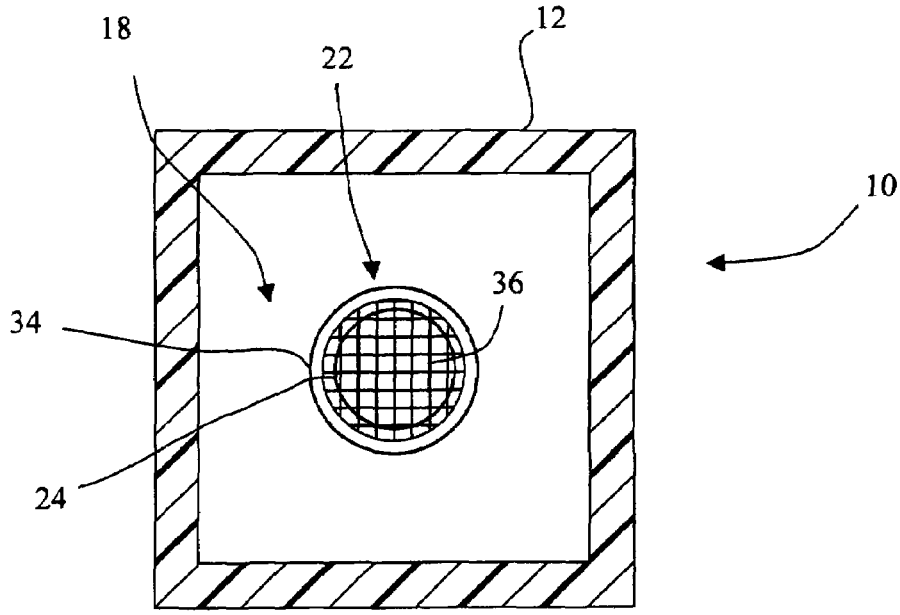
FIG. 1B is a top sectional view of the printing cartridge of FIG. 1A.

Referring now to the drawings and particularly to FIGS. 1A and 1B, there is shown in sectional views a printing cartridge 10 assembled in accordance with the present invention. FIG. 1A is a side sectional view of printing cartridge 10, and FIG. 1B is a top sectional view of printing cartridge 10.

Printing cartridge 10 includes a body 12, a cap 14 and a printhead 16.

Body 12 forms a reservoir in the form of a cavity 18 for holding a supply of ink. Body 12 includes a base 20 to which printhead 16 is attached. Extending upwardly from base 20 into cavity 18 is a filter tower assembly 22 configured in accordance with the present invention, as will be more fully described below. Filter tower assembly 22 defines a passageway 24 that leads from cavity 18 to printhead 16.

Filter tower assembly 22 includes a tower 26 having a proximal end 28 and a distal end 30. Proximal end 28 is attached to base 20, and in the embodiment shown, is formed integral with base 20 during an injection molding operation. Distal end 30 includes a surface 32. Tower 26, as well as base 20 in the case of integral formation, is made from a first polymer material, such as a crystalline polymer or a semi-crystalline polymer. Examples of such polymers include polyethylene terephtalate (PET), polybutylene terephtalate (PBT), polytrimethylene terephtalate (TTT) or PET/PBT (commercially available as Valox 855). Of course, the entirety of body 12 may be formed from the first polymer material during the injection molding operation.

A frame 34, made of a second polymer material different from the first polymer material, is attached to surface 32 of tower 26. The second polymer material may be, for example, an amorphous polymer. Such an amorphous polymer may be, for example, a polyphenylene ether/polystyrene blend, commercially available as Noryl SE1.

A filter 36 is attached to frame 34 and is positioned to extend over passageway 24. Filter 36 may be, for example, a metal mesh, such as a stainless steel mesh.

Depending on the particular configuration of tower 26 and frame 34, in some embodiments, filter 36 will not contact the material of tower 26. In other embodiments, however, filter 36 may contact both the material of frame 34 and the differing material of tower 26.

Figure 2:
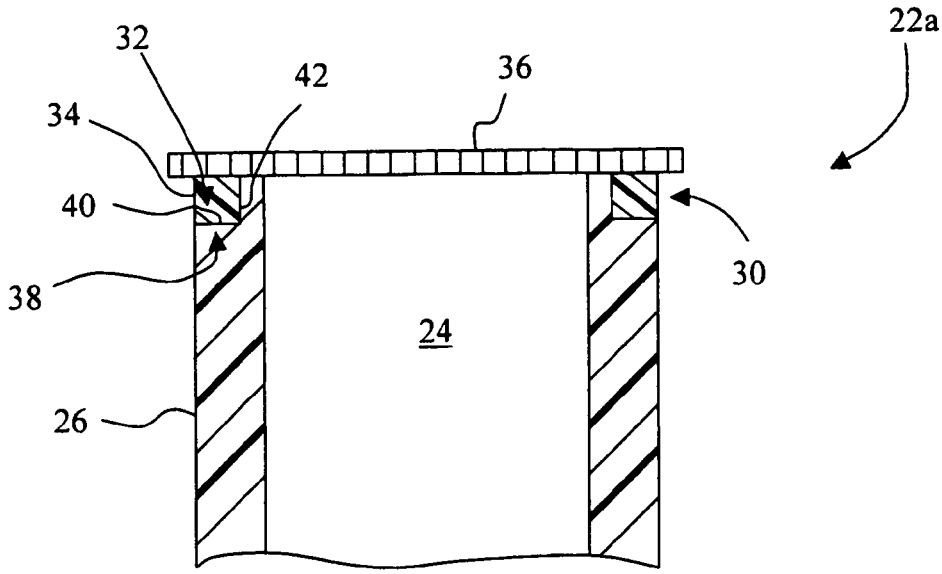
FIG. 2 is a side sectional view of one embodiment of the filter tower assembly of FIGS. 1A and 1B.

Referring to FIG. 2, there is shown a side sectional view of one embodiment of filter tower assembly 22 of FIGS. 1A and 1B, identified as filter tower assembly 22*a*. In this embodiment, tower 26 has an exterior channel 38 formed around its outer periphery, thereby defining surface 32 as a two faced surface including a ledge 40 and an exterior wall 42. Frame 34 may be sized to snuggly fit around exterior wall 42 of exterior channel 38 of tower 26, such that frame 34 is in a state of slight tension, and is positioned to be in contact with ledge 40. As shown, filter 36 is positioned in contact with frame 34, and may also contact distal end 30 of tower 26.

Thereafter, a heating block, e.g., a copper electrical heating block, is placed in pressure contact with filter 36, which in turn transfers heat to frame 34 and transfers heat to tower 26. The amorphous polymer of frame 34 will soften and extrude into or through filter 36, and will soften to engage the tower material. Also, if distal end 30 of tower reaches its melting point, which will occur abruptly due to the properties of the first polymer material, e.g., crystalline polymer or semi-crystalline polymer, the first polymer material may also extrude into or through filter 36, and also combine with the second polymer material of frame 34. When the heating block is removed, the amorphous polymer of frame 34 cools, thereby bonding to filter 36 and also bonding to the material of tower 26, and thereby providing a seal between filter 36 and tower 26, such that a fluid flow through passageway 24 necessarily has passed through filter 36.

Figure 3A:
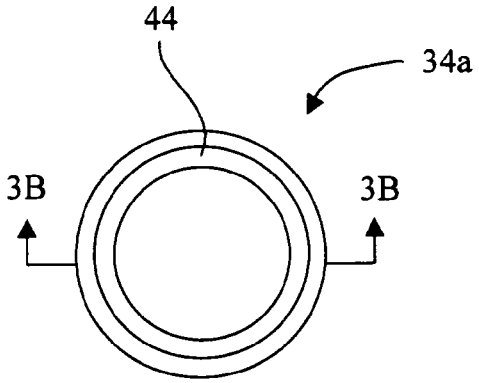
FIG. 3A is a top view of one embodiment of a frame suitable for use with the filter tower assembly of FIG. 2.
Figure 3B:
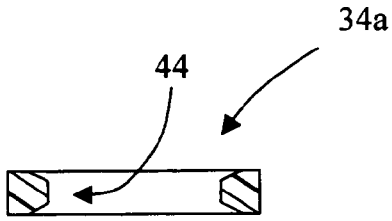
FIG. 3B is a side sectional view of the frame of FIG. 3A.

FIG. 3A is a top view of one embodiment of frame 34, identified as frame 34*a*, suitable for use with the filter tower assembly 22*a* of FIG. 2. FIG. 3B is a side sectional view of frame 34*a*. As shown, frame 34*a* includes a beveled interior region 44. In this embodiment, beveled interior region 44 is continuous around the inner periphery of frame 34*a*. The beveled interior region 44 aids in guiding frame 34*a* into position over tower 26. While frame 34*a* is shaped as an annular ring in the embodiment shown, the actual shape of frame 34*a* will depend on the shape of tower 26 and/or exterior channel 38.

Figure 4:
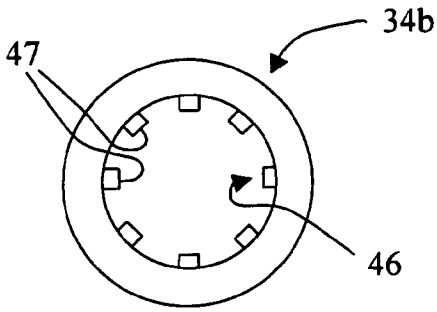
FIG. 4 is a top view of another embodiment of a frame suitable for use with the filter tower assembly of FIG. 2.

FIG. 4 is a top view of another embodiment of frame 34, identified as frame 34*b*, suitable for use with filter tower assembly 22*a* of FIG. 2. As shown, frame 34*b* includes an interior region 46. In this embodiment, interior region 46, which may also be beveled, is not continuous around the inner periphery of frame 34*b*, thereby defining a plurality of interference protrusions 47 (only two of which are labeled for clarity of the figure). The plurality of interference protrusions 47 aid in guiding frame 34*b* into position over tower 26. While frame 34*b* is shaped as an annular ring in the embodiment shown, the actual shape of frame 34*b* will depend on the shape of tower 26 and/or exterior channel 38.

Figure 5:
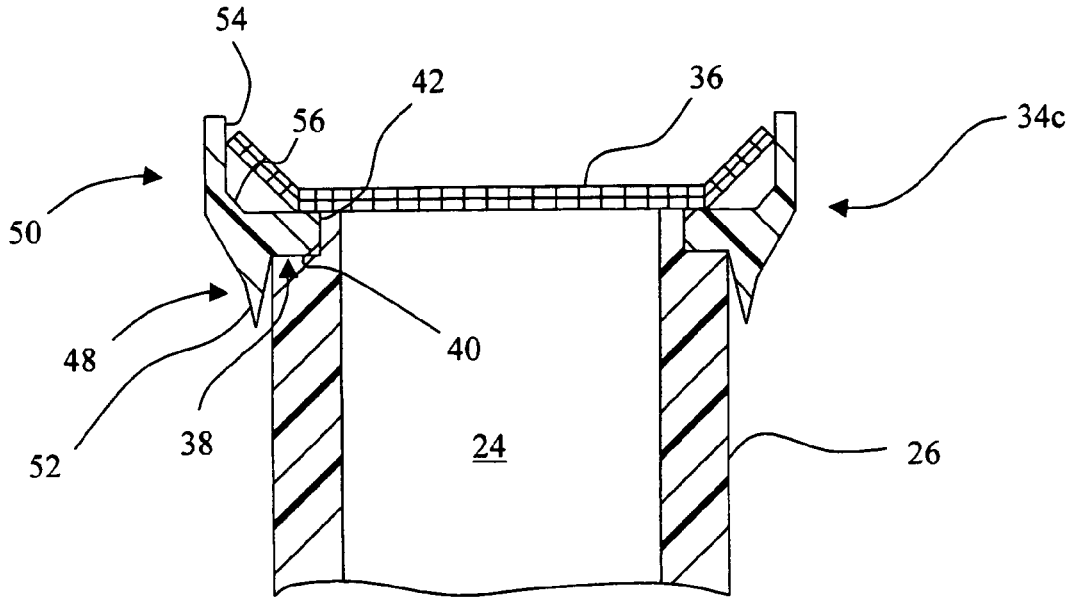
FIG. 5 is a variant of the filter tower assembly of FIG. 2, with the frame including guide features to simplify assembly.

FIG. 5 is a variant of the filter tower assembly of FIG. 2, with another embodiment of frame 34, identified as frame 34*c*, including guide features 48 and 50 to simplify assembly, and which extend in opposite directions. Guide feature 48 is sized and configured to be received around tower 26 as frame 34*c* is received in exterior channel 38. Guide feature 48 may be in the form of a lower lip 52 that is continuous around the periphery of frame 34*c*, or alternatively, may be discontinuous so long as it can perform its guiding and positioning functions. Guide feature 50 is sized and configured to receive, to guide, and to center filter 36 in position over passageway 24. As such, guide feature 50 includes an upper lip 54 and an interior beveled surface 56. Guide feature 50 may be continuous around the periphery of frame 34*c*, or alternatively, may be discontinuous so long as it can perform its guiding and positioning functions.

In the embodiment shown in FIG. 5, filter 36 may be oversized with respect to the opening defined by guide feature 50, such that the edges of filter 36 will engage guide feature 50 when inserted with a force into guide feature 50. Thus, filter 36 is placed in a state of compression to hold filter 36 in position in frame 34*c*, and adopts a somewhat concave profile with respect to the insertion direction. As such, the edges of filter 36 bite into guide feature 50, thereby attaching filter 36 to frame 34*c*.

Figure 6:
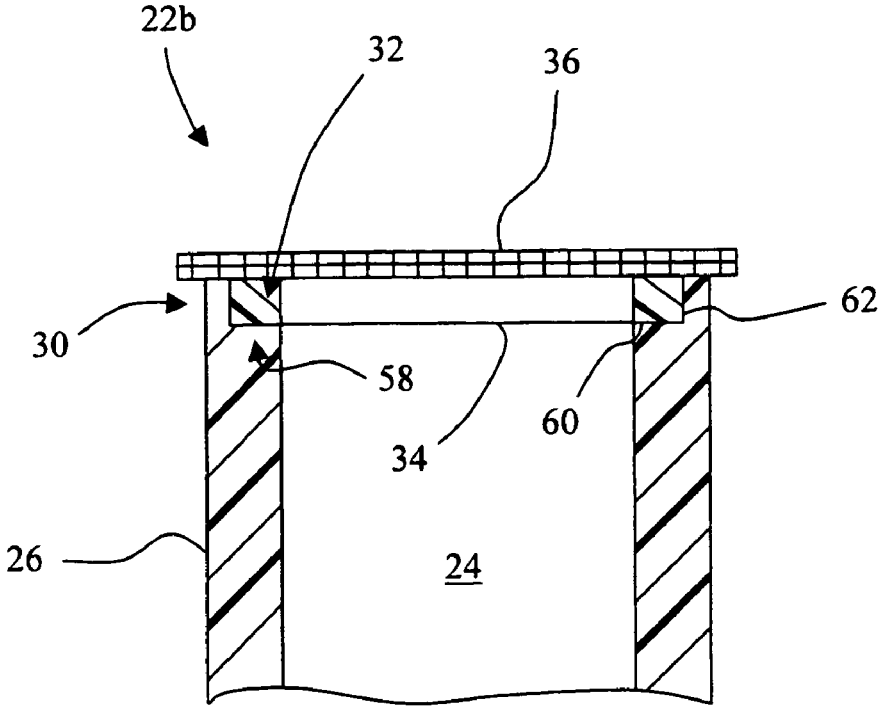
FIG. 6 is a side sectional view of another embodiment of the filter tower assembly of FIGS. 1A and 1B.

Referring to FIG. 6, there is shown a side sectional view of another embodiment of filter tower assembly 22 of FIGS. 1A and 1B, identified as filter tower assembly 22*b*. In this embodiment, tower 26 has an interior channel 58 formed around its inner periphery, thereby defining surface 32 as a two faced surface including a ledge 60 and an interior wall 62. Frame 34 may be sized to snuggly fit interior wall 62 of interior channel 58 of tower 26, such that frame 34 is in a state of slight compression, and is positioned to be in contact with ledge 60. As shown, filter 36 is positioned in contact with frame 34, and may also contact distal end 30 of tower 26. Final attachment may be achieved using a heat staking process, as identified above.

Figure 7:
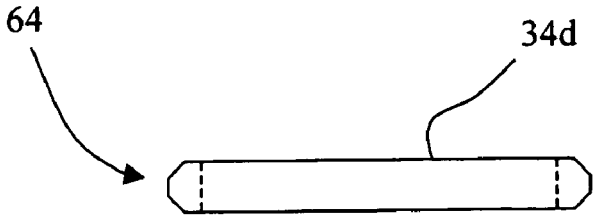
FIG. 7 is a side view of one embodiment of a frame suitable for use with the filter tower assembly of FIG. 6.

FIG. 7 is a side view of one embodiment of frame 34, identified as frame 34*d*, suitable for use with filter tower assembly 22*b* of FIG. 6. As shown, frame 34*d* includes a beveled exterior region 64. In the embodiment shown, beveled exterior region 64 is continuous around the outer periphery of frame 34*d*. However, in another embodiment, beveled exterior region 64 may be discontinuous around the outer periphery of frame 34*d*. The beveled exterior region 64 aids in guiding frame 34*d* into position in interior channel 58 of tower 26. While the frame 34*d* is shaped as an annular ring in the embodiment shown, the actual shape of frame 34*d* will depend on the shape of tower 26 and/or interior channel 58.

Figure 8:
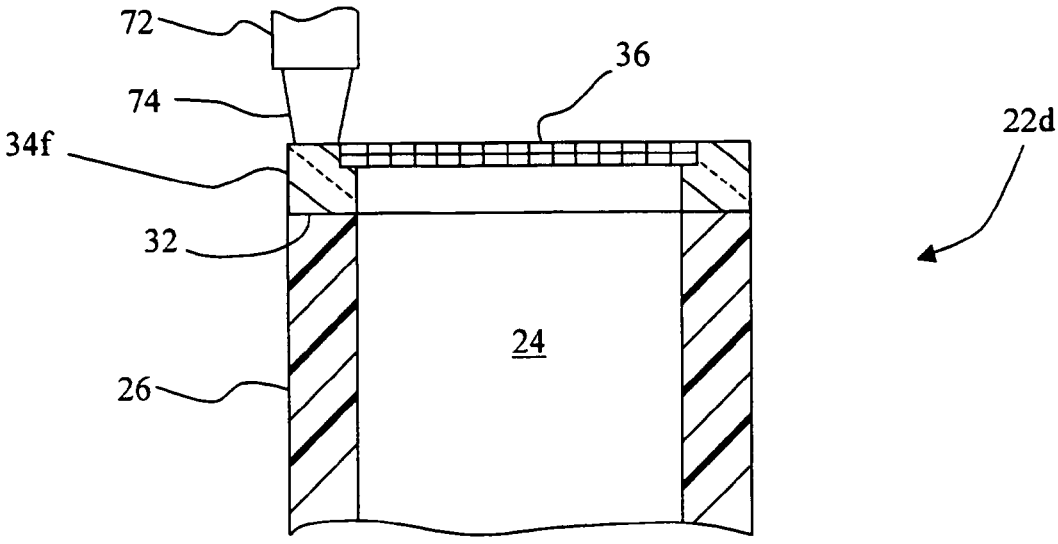
FIG. 8 is a side sectional view of another embodiment of the filter tower assembly of FIGS. 1A and 1B.

Referring to FIG. 8, there is shown a side sectional view of another embodiment of filter tower assembly 22 of FIGS. 1A and 1B, identified as filter tower assembly 22*d*. In this embodiment, tower 26 defines surface 32 as a single faced surface. In this embodiment, a frame 34*f* is made of a material transparent to laser radiation (hereinafter laser radiation transparent), such as a material having a laser radiation transmission rate of 30 percent or greater. Such materials may include, for example, an amorphous polymer, such as poly(cyclohexylene dimethylene terephtalate) acid (PCTA; commercially available as DuraStar DS1010), poly (cyclohexylene dimethylene terephtalate) glycol (PCTG), poly(ethylene terephthalate glycol (PETG), or amorphous alloys such as PBT/PC or PBT/ABS. Tower 26 is made from a material that is absorbent to laser radiation (hereinafter laser radiation absorbent), e.g., a semi-crystalline polymer, such as for example, polyethylene terephtalate (PET), polybutylene terephtalate (PBT), polytrimethylene terephtalate (TTT) or PET/PBT (commercially available as Valox 855), and will act as a laser absorbing layer. Frame 34*f*, made of the laser radiation transparent material, is positioned in contact with tower 26 at surface 32. Filter 36, made from a metal mesh, is affixed to frame 34*f*. A laser 72 generates and focuses laser radiation 74, such as near infrared with a wavelength ranged from 700 nanometers (nm) to 1250 nm, which is directed into the laser radiation transparent amorphous frame 34*f* and impinges the laser radiation absorbent first polymer material of tower 26 at surface 32, which in turn generates heat and transfers heat to frame 34*f*. The amorphous polymer of frame 34*f* will soften, and upon the application of pressure will engage the tower material of tower 26. When laser radiation 74 is removed, the amorphous polymer of frame 34*f* cools, thereby bonding to the material of tower 26. Thus, frame 34*f* provides a seal between filter 36 and tower 26, such that a fluid flow through passageway 24 necessarily has passed through filter 36.

As an alternative, frame 34*f* may be attached to tower 26 using the laser process described above, and then filter 36 may be attached to the frame, for example, using the heat staking process, also described above.

As an alternative to the laser process as just described above, the amorphous polymer of frame 34 may be heated to a softened state using the heating block process or an ultrasonic welding process.

Figure 9A:
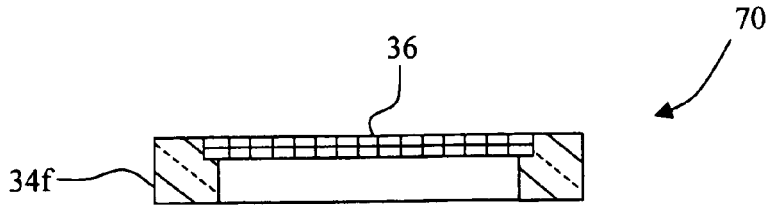
FIG. 9A is a side sectional view of an integrated frame and filter prior to their attachment to a tower.
Figure 9B:
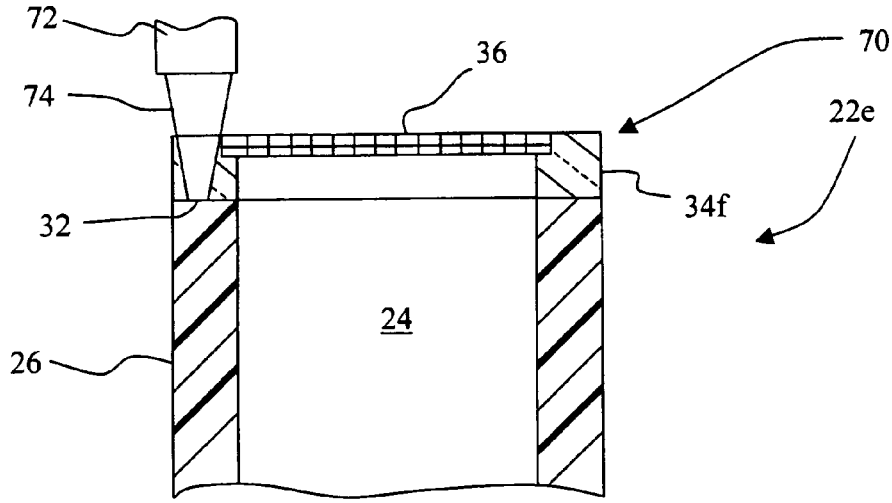
FIG. 9B is a side sectional view of another embodiment of the filter tower assembly of FIGS. 1A and 1B, including the integrated frame and filter of FIG. 9A.

FIG. 9A is a side sectional view of an integrated frame and filter assembly 70 prior to its attachment to tower 26, and FIG. 9B is a side sectional view of another embodiment of filter tower assembly 22 of FIGS. 1A and 1B, identified as filter tower assembly 22*e*, including integrated frame and filter 70 of FIG. 9A.

Referring to FIG. 9A, integrated frame and filter assembly 70 is first formed by attaching filter 36 to a frame, such as frame 34*f*, in a lamination process or by insert molding filter 36 to frame 34*f*, for example. Such attachment may be made, for example, using adhesives, or thermal bonding. Referring to FIG. 9B, integrated frame and filter assembly 70 is then positioned in contact with surface 32 of tower 26. Thereafter, integrated frame and filter assembly 70 is bonded to tower 26 using laser 72. Laser 72 generates laser radiation 74, which is directed into the laser radiation transparent amorphous frame 34*f* and impinges the laser radiation absorbent first polymer material, e.g., a crystalline or semi-crystalline polymer, of tower 26 at surface 32, which in turn generates heat and transfers heat to frame 34*f*. The amorphous polymer of frame 34*f* will soften and engage the tower material of tower 26. When laser radiation 74 is removed, the amorphous polymer of frame 34*f* cools, thereby bonding to the material of tower 26. Thus, frame 34*f* provides a seal between filter 36 and tower 26, such that a fluid flow through passageway 24 necessarily has passed through filter 36.

As an alternative to the laser process as described above, the amorphous polymer of frame 34 may be heated to a softened state using, for example, the heating block process or the ultrasonic welding process, as identified above.

While this invention has been described with respect to several embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printing cartridge, comprising:

a body including a base and a tower defining a passageway, said tower having a proximal end and a distal end, said proximal end being attached to said base, said distal end including a surface, said tower being made from a first polymer material;

a frame, made of a second polymer material different from said first polymer material, attached to said surface of said tower; and a filter attached to said frame and positioned to extend over said passageway.

2. The printing cartridge of claim 1, said first polymer material being one of a crystalline polymer and a semi-crystalline polymer.

3. The printing cartridge of claim 1, wherein said second polymer material is an amorphous polymer.

4. The printing cartridge of claim 1, wherein said filter contacts said first polymer material.

5. The printing cartridge of claim 1, wherein said frame provides a seal between said filter and said tower, such that a fluid flow through said passageway necessarily has passed through said filter.

6. The printing cartridge of claim 1, wherein said frame includes a guide feature for guiding said frame into position with respect to said tower.

7. The printing cartridge of claim 1, wherein said frame includes a guide feature for receiving and positioning said filter with respect to said passageway.

8. The printing cartridge of claim 1, wherein said first polymer material is one of a crystalline polymer and a semi-crystalline polymer, and said second polymer material is an amorphous polymer.

9. The printing cartridge of claim 8, wherein said filter is a metal mesh.

10. The printing cartridge of claim 8, said frame made of said amorphous polymer being attached to said filter and attached to said tower made of one of said crystalline polymer and said semi-crystalline polymer, by heating said amorphous polymer to be in a softened state.

11. The printing cartridge of claim 10, wherein said heating is effected using one of an electrical heating block and an ultrasonic unit.

12. The printing cartridge of claim 1, said surface defining an exterior ledge and an exterior wall of said tower, said frame being fitted over said exterior wall and positioned in contact with said exterior ledge.

13. The printing cartridge of claim 12, said frame being in a state of expansion before said frame is heated to attach said frame to said tower.

14. The printing cartridge of claim 1, said surface defining an interior ledge and an interior wall of said tower, said frame being fitted within said interior wall and positioned in contact with said interior ledge.

15. The printing cartridge of claim 14, said frame being in a state of compression before said frame is heated to attach said frame to said tower.

16. The printing cartridge of claim 1, wherein said frame is attached to said tower when said filter is attached to said frame.

17. The printing cartridge of claim 1, wherein said filter is attached to said frame to form an integrated assembly prior to said integrated assembly being attached to said tower.

18. The printing cartridge of claim 1, wherein said second polymer material is softened to attach to said tower.

19. The printing cartridge of claim 1, wherein said first polymer material of said tower is a material that is absorbent to laser radiation and said second polymer material of said frame is a material that is transparent to said laser radiation, with a transmission rate of 30 percent or greater.

20. The printing cartridge of claim 19, said frame being attached to said tower by directing laser radiation through said material of said frame to impinge said tower to generate heat to place said frame in a softened state.

21. The printing cartridge of claim 20, said frame being made of an amorphous polymer.

22. The printing cartridge of claim 21, said tower being made of one of a crystalline polymer and a semi-crystalline polymer.

23. The printing cartridge of claim 1, wherein said first polymer material of said tower is a material that is absorbent to laser radiation and said second polymer material of said frame is a material that is transparent to said laser radiation.

24. The printing cartridge of claim 1, said frame including a guide feature for receiving and positioning said filter, said filter being sized to engage said guide feature, placing said filter in a state of compression.

* * * * *